United States Patent [19]

Takeda et al.

[11] Patent Number: 4,682,639

[45] Date of Patent: Jul. 28, 1987

[54] APPARATUS FOR CUTTING VENEER PIECES INTO EQUAL SECTIONS

[75] Inventors: Shigeki Takeda, Tokyo; Sachio Maekawa, Okazaki, both of Japan

[73] Assignee: Hashimoto Denki Co., Ltd., Takahama, Japan

[21] Appl. No.: 811,751

[22] Filed: Dec. 20, 1985

[30] Foreign Application Priority Data

Aug. 26, 1985 [JP] Japan ..... 60-187050

[51] Int. Cl.[4] ..... B27B 1/00

[52] U.S. Cl. ..... 144/2 R; 83/107; 83/367; 83/417; 83/435.2; 83/732; 144/49; 144/242 M; 144/245 A; 144/245 F; 144/246 F; 144/245 D; 144/356; 144/379

[58] Field of Search ..... 144/2 R, 3 R, 242 M, 144/245 R, 245 A, 245 F, 245 D, 246 F, 356, 379, 49; 83/107, 367, 417, 422, 732, 435.2

[56] References Cited

U.S. PATENT DOCUMENTS

| | | | |
|---|---|---|---|
| 2,501,299 | 3/1950 | Anderson | 83/435.2 |
| 2,593,745 | 4/1952 | Gillespie | 83/435.2 |
| 2,616,501 | 11/1952 | Smith | 83/435.2 |
| 4,011,779 | 3/1977 | Berg | 83/367 |
| 4,173,238 | 11/1979 | Pryor et al. | 83/367 |
| 4,196,760 | 4/1980 | McDaniel et al. | 83/422 |
| 4,340,137 | 7/1982 | Foster | 144/242 M |

*Primary Examiner*—W. D. Bray

*Attorney, Agent, or Firm*—Wenderoth, Lind & Ponack

[57] ABSTRACT

An apparatus for cutting a veneer piece into equal sections includes a main conveyer for feeding the veneer piece in a direction transverse to the wood fibers thereof and a cutter disposed in the main conveyer for cutting the veneer piece along the feeding direction thereof. A straightening unit is provided at the upstream position of the cutter for controlling the orientation of the veneer piece on the main conveyor in such a manner that the fibers precisely extend along the transverse direction of the main conveyer, the unit including a plurality of retractable stoppers capable of projecting from the main conveyer to stop the veneer piece for a predetermined time. A multiple conveyer system extends from the downstream end of the main conveyer to transport the sections of the cut veneer pieces to a single feeder at different timings, the feeder conveying the sections to an apparatus for forming seam plates.

9 Claims, 5 Drawing Figures

74

APPARATUS FOR CUTTING VENEER PIECES INTO EQUAL SECTIONS

BACKGROUND OF THE INVENTION

This invention relates to an apparatus for cutting veneer pieces and, more particularly, to a cutting apparatus for dividing the veneer pieces into equal sections which may be utilized for producing seam plates.

In manufacturing plywood, a log of predetermined length is subjected to a rotary lathe or other suitable devices in order to obtain thin sheets of veneer peeled from the log. A continuous veneer sheet, if it extends the full length of the log, is cut into plates which are then processed to form a plywood sheet. The log, however, often has an irregular-shaped end or recess that creates irregular surface portions appeared at intervals on one of the edges of the veneer sheet. Such irregular portions must be removed by cutting the veneer sheet in a direction along which the wood fibers extend, resulting in rectangular veneer pieces one of which has an irregular surface at one of its shorter edges. Not using such veneer pieces lowers the efficiency of usage of wood materials.

In order to achieve maximum efficiency, it has been known in the art to provide a slit or groove on the circumference of the log at the longitudinal center thereof so that two veneer sheets each having a half length of the log may be peeled off by the operation of the rotary lathe, only one of the sheets including the irregular surface. These sheets are cut into pieces which, after removing those having the irregular surface, are joined together to form a seam plate which in turn can be used as a core of plywood. However, this initial separation involves disadvantages that the number of veneer pieces to be joined is doubled and therefore the subsequent process requires an increased amount of work, while reducing the number of seamless plates to be obtained. Further, when the log is peeled to a depth where the groove terminates, the rotary lathe begins to furnish a single veneer sheet having the full length of the log, and this still lowers efficiency of the subsequent process.

Japanese Patent No. 1057528 (Publication No. 55-47562) discloses an automatic system for removing an irregular-shaped portion from a veneer piece and for joining together veneer pieces or sections of regular length to form a seam plate. However, a cutting device disclosed therein is adapted only to cut the veneer piece along the direction of the wood fibers and is not adapted to cut it along the transverse direction. Therefore, if the veneer pieces having the full length of the log are processed in such a system, waste of wood materials is inevitably increased.

Accordingly, an object of the present invention is to provide an apparatus which may efficietly and precisely cut a veneer piece into equal sections along the transverse direction thereof.

Another object of the present invention is to provide a cutting apparatus of the type set forth above which is particularly suitable for use in combination with a known automatic system for forming seam plates.

A still further object of the invention is the provision of a cutting apparatus which may automatically the orientation or posture of a veneer piece from a random mass thereof before cutting.

SUMMARY OF THE INVENTION

According to the present invention, an apparatus for cutting a veneer piece extending longitudinally along a direction of fibers thereof and having an irregular surface at one of the shorter edges into equal sections comprises a main conveyer arranged for feeding the veneer piece in a direction transverse to the fibers thereof and means for forwarding the veneer piece along the longitudinal axis from a mass thereof onto said main conveyer. A straightening unit is provided for controlling the orientation or posture of the veneer piece on said main conveyer in such a manner that the fibers precisely extend along the transverse direction of the main conveyer, the straightening unit including a plurality of retractable stoppers capable of projecting from the main conveyer to stop the veneer piece for a predetermined time. A pair of guide belts extend along the opposite sides of the main conveyer for preventing change of the orientation or posture of the straightened veneer piece. A cutter is disposed in the main conveyer at a position downstream of the straightening unit and is so arranged as to cut the veneer piece along the feeding direction thereof. A multiple conveyer system is provided to transport the sections of the cut veneer piece to a single feeder at different timings, the feeder conveying the sections to means for forming seam plates.

The main conveyer preferably comprises a plurality of conveyer belts separated from each other, and each of the stoppers of the straightening unit may be disposed between the adjacent conveyer belts.

The means for forwarding the veneer piece onto the main conveyer may comprise a pair of pinch rollers mounted at one of the sides of the main conveyer.

Preferably, the straightening unit further includes a shaft formed integrally with the stoppers and extending in the transverse direction of the main conveyer, an actuator connected to the shaft for rotation thereof, a sensor for detecting the presence of the veneer piece and giving a signal to the actuator, and means for delaying the signal to the actuator for a predetermined period of time.

Other objects, features and advantages of the present invention will be apparent from the following detailed description of preferred embodiments thereof when taken in conjunction with the accompanying drawings, in which:

DETAILED DESCRIPTION OF THE INVENTION

Figure 1:
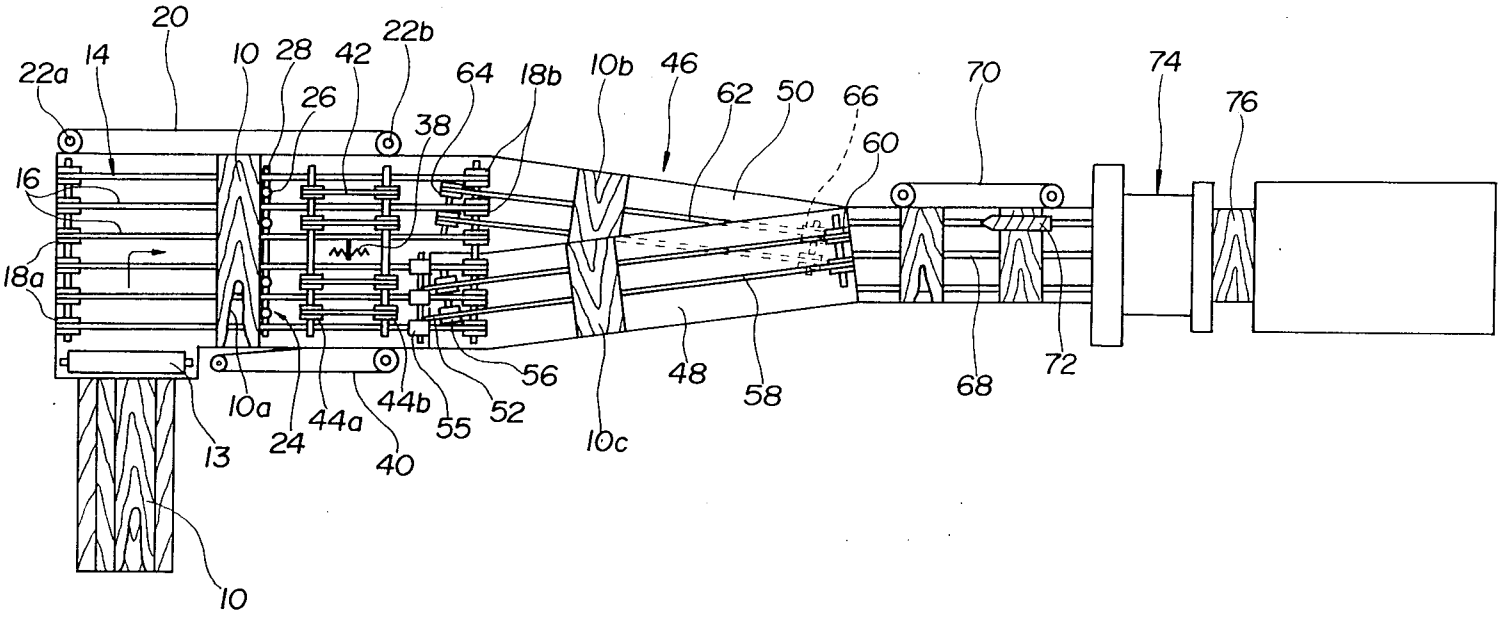
FIG. 1 is a schematic plan view illustrating an apparatus according to an embodiment of the invention.
Figure 2:
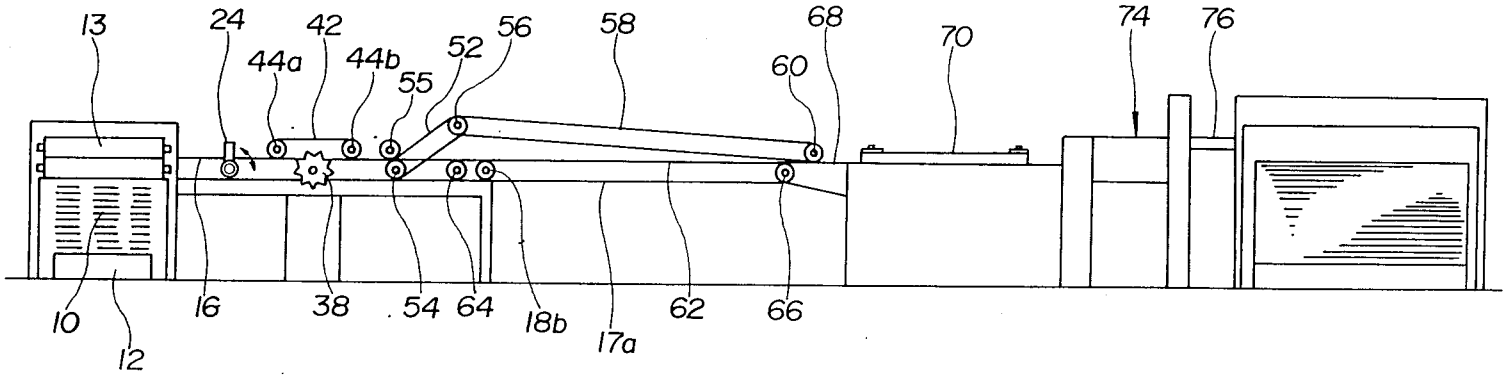
FIG. 2 is a schematic side view of the apparatus in FIG. 1.
Figure 3:
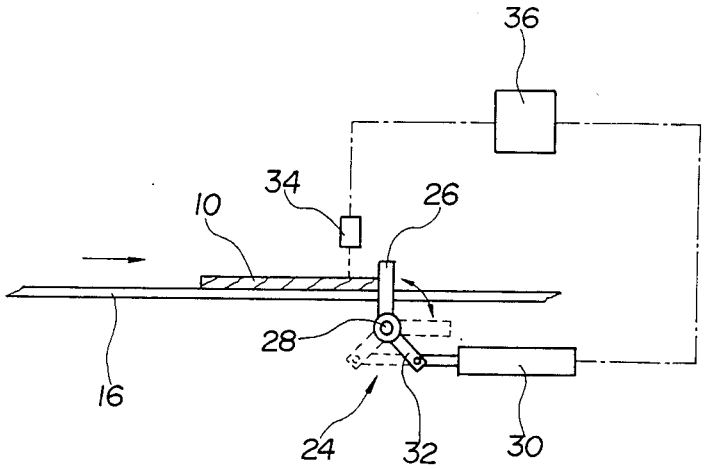
FIG. 3 is an enlarged side view illustrating a straightening unit of the apparatus in FIG. 1.
Figure 4:
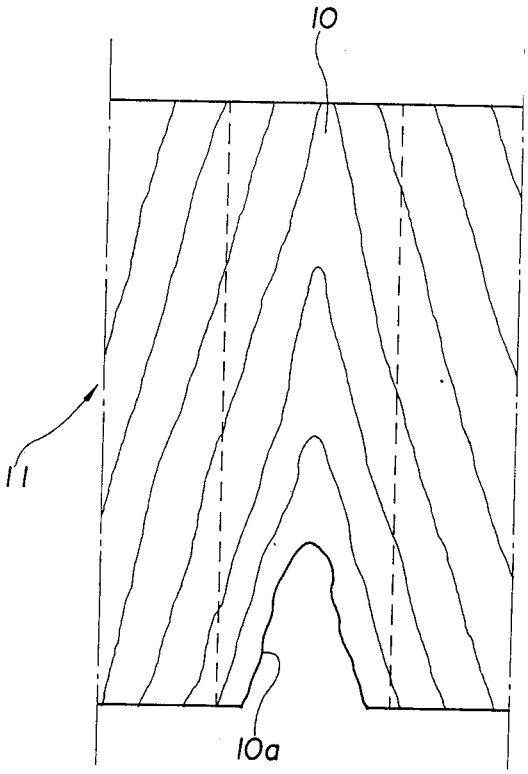
FIG. 4 is a plan view showing a veneer sheet from which veneer pieces are to be separated.

Referring now to FIGS. 1 to 3 of the drawings there is illustrated an apparatus for cutting a veneer piece according to a preferred embodiment of the present invention, which includes a movable table 12 for loading veneer pieces 10 therein. Each veneer piece has an irregular surface 10*a* at one of the shorter edges and has been separated from a continuous veneer 11 by cutting a portion thereof having such irregular edge, as shown in FIG. 4. The veneer 11 is a flexible thin sheet peeled off or sliced, by a rotary lathe or other suitable devices, from a log of predetermined length which is equal to the length of the veneer piece 10. The pieces 10 were dried in a preceding process before being loaded on the table 12 of the present apparatus.

The table 12 is movable in a vertical direction in FIG. 2 for furnishing the uppermost piece 10 onto a belt conveyer 14 through a pair of pinch rollers 13 which feed the piece 10 along the longitudinal axis thereof along which wood fibers extend. The conveyer 14 comprises a plurality of belts 16 spaced from each other and extending between pulleys 18*a* and 18*b* which are adapted to move the belts 16 in a direction crossing with the longitudinal axis of the piece 10 at substantially right angles. A guide belt 20 is provided to extend between pulleys 22*a* and 22*b* in parallel with the conveyer belts 16 so that the front shorter edge, opposite to the irregular surface 10*a*, of the veneer piece 10 abuts against the guide belt 20, thus preventing random orientation or posture of the piece 10 fed onto the conveyer 14 from the pinch rollers 13. Thus, the longitudinal axis of the piece 10 is arranged at substantially right angles to the direction of transportation by belts 16.

Provided at an axially intermediate portion of the conveyer 14 is a straightening unit 24 for precisely controlling the posture or orientation of veneer piece 10 on the conveyer. This unit 24 includes a plurality of stoppers or projections 26 each of which is located between the adjacent belts 16 and projects upwardly to catch the front longer edge of the piece 10 when the projection is in an upright position. These projections 26 are aligned with each other so that the axis of the piece 10 is precisely arranged in the transverse direction of the conveyer 14 when the piece 10 abuts against all of the projections 26, as shown in FIG. 1.

The unit 24 also includes means for retracting the projections 26 to thereby permit the straightened piece 10 to be further conveyed and, in this embodiment, such means comprises a transverse shaft 28 formed integrally with the projections 26. As illustrated in FIG. 3, the shaft 28 is pivotably connected to an actuator 30 such as an air cylinder by an arm 32. A detector 34 comprising, for example, a photoelectric switch or limit switch is provided for detecting the piece 10 and simultaneously giving a signal to the actuator 30 through a controller 36. The controller has a circuit which delays the signal to the actuator 30 for a period of time sufficient to have the front edge of the veneer piece 10 on the conveyer 14 to abut against all of the projections 26. The actuator 30, when receiving the delayed signal, rotates the shaft 28 about 90 degrees in order to retract the projections 26 below the conveyer belts 16, the retracted position being shown by dotted lines in FIG. 3. After the veneer piece 10 is conveyed beyond the unit 24, a signal from the detector 34 again actuates the device 30 to rotate the projections 26 to the operative position.

Reference numeral 38 indicates a cutter such as a circular saw secured at the transverse center of the conveyer 14 and spaced from the straightening unit 24 in the direction of movement of the veneer piece 10. A second guide belt 40 extends in parallel with the first one 20 at the opposite side of the conveyer 14 for cooperating with the first one 20 in order to catch the shorter edges of the piece 10 and to avoid change of the straightened posture or orientation thereof until it is cut into halves by the cutter 38. In addition, press belts 42 extending between pulleys 44*a* and 44*b* and above the conveyer 14 force the piece 10 against the conveyer 14 to prevent the orientation of piece 10 from changing due to a stress generated during the cutting operation.

For the two pieces of the veneer 10 to a subsequent process, there is provided a dual conveyer system 46, an initial portion of which is overlapped with the end portion of the conveyer 14 so that each half piece is shifted onto the dual conveyer without being stopped. The dual conveyer system 46 comprises an upper unit 48 for carrying a rear half 10*c* of the veneer piece and a lower unit 50 for a front half 10*b*, each unit having a width equal to half that of the conveyer 14 and extending obliquely toward an assumed, extended center of the conveyer 14 to connect the downstream end of each unit to a single feeder 68 for a subsequent processing device, as shown in FIG. 1. The upper unit 48 has first conveyer belts 52 extending between initial pulleys 54 and top pulleys 56 from which second conveyer belts 58 extend to end pulleys 60, while the lower unit 50 comprises horizontal belts 62 running between end pulleys 66 and initial pulleys 64 which are positioned below the top pulleys 56, as illustrated in FIG. 2.

These upper and lower units 48 and 50 are adapted to be driven at different speeds in order to ensure that one of the halves 10*b* and 10*c* reaches the feeder 68 at delayed timing. An additional guide belt 70 extends in parallel with the feeder 68 to maintain the posture or orientation of the half pieces, and a spiral roll 72 or other suitable means is provided on the feeder 68 to cause one of the shorter edges of each piece to abut against the guide belt 70.

A frame 72 is provided to support the parts of the apparatus thereon. Reference numeral 55 indicates a roller which presses the rear half piece 10*c* against the first belt 52 for ensuring smooth transfer of the rear piece 10*c* to the upper unit 48.

Figure 5:
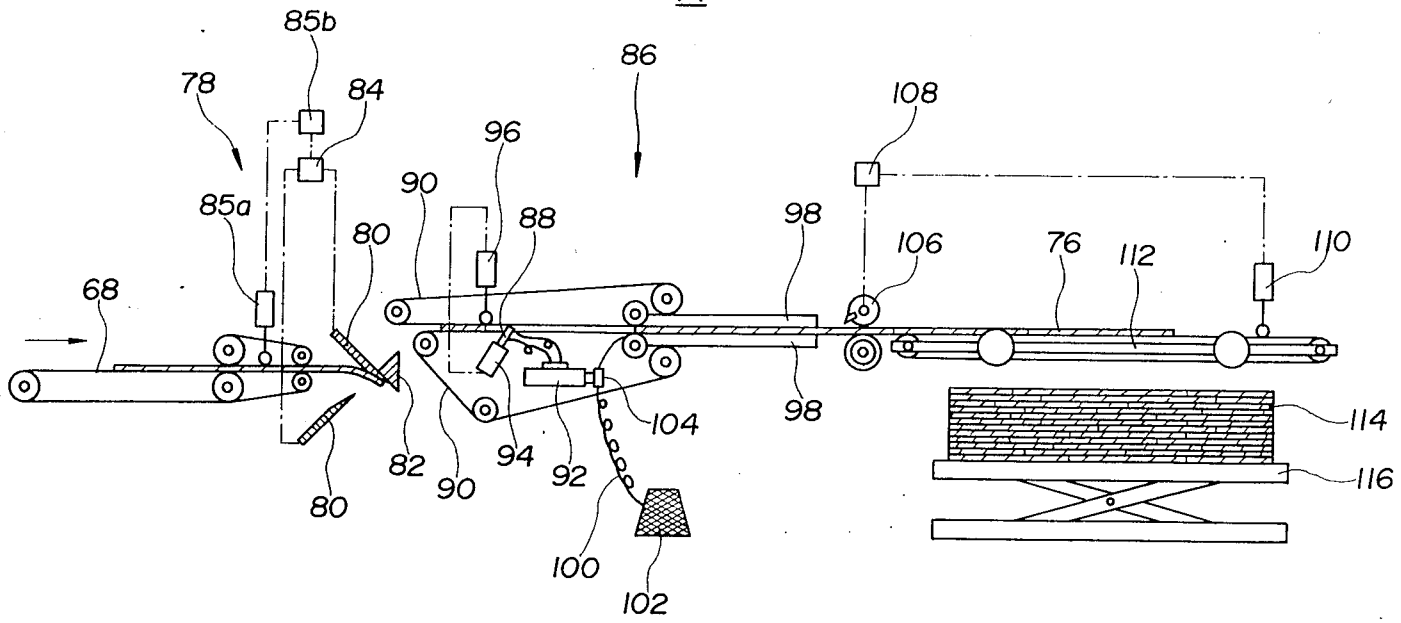
FIG. 5 is a schematic side view illustrating a device for forming seam plates.

The feeder 68 is a belt conveyer for feeding the half pieces to a known automatic system generally indicated by numeral 74 which is adapted to remove the irregular surface portion and to join the pieces together so that a continuous plate 76, having the half length of the veneer piece 10 in the direction of wood fiber, may be obtained. Such an automatic system is disclosed in, for example, Japanese Patent No. 1057528 (Publication No. 55-47562) which shows a device as generally illustrated in FIG. 5. The device includes a cutting unit 78 comprising a pair of movable blades 80 which coact with a fixed triangular blade 82 to remove a portion including the irregular surface and extending the full length of the half pieces. Thus, the half piece 10*b* in FIG. 1 is cut into three sections along the axis and an intermediate section thereof having the recess 10*a* is removed while opposite side sections are forwarded to a joining unit 86. An electrically controlled actuator 84 causes the blades 80 to alternately advance and retract in accordance with signals from a detector 85*a* and a memory 85*b*. The joining unit 86 has a nozzle 88 for furnishing adhesive material from a reservoir 92 onto the front edge of the veneer conveyed between a pair of belts 90. The nozzle is retractably supported by a cylinder member 94 which is controlled by signals from a detector 96. The belts 90 convey the veneer to a passage defined between a pair of rails 98, where the front edge of one veneer piece abuts against the rear edge of the preceding veneer piece for adhesion therebetween to thereby form the continuous plate 76. A string 100 from a bobbin 102 is impregnated with the adhesive material at 104 and is continuously adhered to the lower surface of the veneer when it enters into the passage between rails 98, so that the adhesion of the veneer piece is reinforced.

The continuous plate 76 may be cut at a predetermined length, in the direction of movement thereof, to prepare a seam plate for use in, for example, a core of a plywood. The cutting device also disclosed in the above Japanese Patent comprises a rotary knife 106 which is intermittently actuated by a drive member 108 in accordance with signals from a detector 110. A conveyer 112 is adapted to open in order to discharge a seam plate 114 of uniform length for storage on a table 116.

As will be understood from the foregoing description, according to the present invention the veneer piece having an irregular surface at one of the shorter edges is exactly and efficiently cut into halves along a direction parallel to the shorter edges and those halves are alternately fed into the known automatic system for forming the seam plate of the half length, in the direction of wood fiber, of the original half piece. Therefore, veneer pieces peeled from a log can be utilized with maximum efficiency. The cutting and feeding operations, including orientation or direction adjustment, of the veneer pieces are carried out without any manual work. In addition, the veneer sheet from the log has a full length of the log in the direction of wood fiber, and this reduces the amount of the veneer pieces that must be joined together.

Although the present invention has been described with reference to the preferred embodiments thereof, many modifications and alterations may be made within the spirit of the invention. For example, the apparatus may be so arranged as to cut the veneer piece into three or more portions.

What is claimed is:

1. An apparatus for cutting into equal sections a veneer piece having a longitudinal dimension in a direction of fibers thereof and having at one of the shorter edges thereof an irregular surface, said apparatus comprising:

a main conveyer arranged for feeding the veneer piece in a feed direction transverse to the longitudinal dimension thereof;

means for forwarding the veneer piece along the longitudinal dimension thereof from a mass of veneer pieces onto said main conveyer;

a straightening unit for controlling the orientation of the veneer piece on said main conveyer in such a manner that the fibers and the longitudinal dimension of the veneer piece precisely extend transverse to said feed direction of said main conveyer, said straightening unit including a plurality of retractable stoppers capable of projecting from said main conveyer to stop the veneer piece for a predetermined time;

a pair of guide belts extending along opposite sides of said main conveyer for preventing a change of the orientation of the veneer piece straightened by said straightening unit;

a cutter disposed in said main conveyer at a position downstream of said straightening unit, said cutter being so arranged as to cut the veneer piece into sections along said feed direction thereof; and a multiple conveyer system to transport the sections of the cut veneer piece at different points in time to a single feeder for conveying the sections to means for forming seam plates.

2. An apparatus as claimed in claim 1, wherein said main conveyer comprises a plurality of conveyer belts separated from each other, each said stopper of said straightening unit being disposed between adjacent said conveyer belts.

3. An apparatus as claimed in claim 1, wherein said means for forwarding the veneer piece onto said main conveyer comprises a pair of pinch rollers mounted at one side of said main conveyer.

4. An apparatus as claimed in claim 1, wherein said straightening unit further includes a shaft formed integrally with said stoppers and extending transverse of said feed direction of said main conveyer, an actuator connected to said shaft for rotation thereof, a sensor for detecting the presence of the veneer piece and for forwarding a signal representative thereof to said actuator, and means for delaying said signal to said actuator for a predetermined period of time.

5. An apparatus as claimed in claim 4, further comprising an arm connecting said actuator to said shaft.

6. An apparatus as claimed in claim 1, wherein said cutter comprises a circular saw disposed at the transverse center of said main container to cut the veneer piece into halves.

7. An apparatus as claimed in claim 6, wherein said multiple conveyer system comprises a lower conveyer unit and an upper conveyer unit, each said unit extending obliquely with respect to said main conveyer and said feeder, and downstream ends of respective said units being overlapped with each other.

8. An apparatus as claimed in claim 7, wherein said upper conveyer unit includes first and second conveyer belts, said first conveyer belt extending upwardly from an upstream end to a top of said unit, and said second conveyer belt extending downwardly from said top to said downstream end of said unit.

9. An apparatus as claimed in claim 1, further comprising press belts extending over said cutter to press the veneer piece against said main conveyer.

* * * * *